US008789540B2

(12) United States Patent
Lee et al.

(10) Patent No.: US 8,789,540 B2
(45) Date of Patent: Jul. 29, 2014

(54) SEALING RING STRUCTURE OF A COSMETIC CONTAINER

(76) Inventors: Yong Jun Lee, Seongnam-si (KR); Jeen Gee Kim, Suwon-si (KR)

( * ) Notice: Subject to any disclaimer, the term of this patent is extended or adjusted under 35 U.S.C. 154(b) by 0 days.

(21) Appl. No.: 13/635,641

(22) PCT Filed: Oct. 28, 2010

(86) PCT No.: PCT/KR2010/007478

§ 371 (c)(1),
(2), (4) Date: Sep. 17, 2012

(87) PCT Pub. No.: WO2011/115346

PCT Pub. Date: Sep. 22, 2011

(65) Prior Publication Data

US 2013/0087165 A1 Apr. 11, 2013

(30) Foreign Application Priority Data

Mar. 18, 2010 (KR) ..... 10-2010-0024340
Sep. 7, 2010 (KR) ..... 10-2010-0087380

(51) Int. Cl.

| | |
|---|---|
| ***A45D 33/00*** | (2006.01) |
| ***A45D 33/24*** | (2006.01) |
| ***B65D 69/00*** | (2006.01) |
| ***B65D 71/00*** | (2006.01) |
| ***B65D 43/26*** | (2006.01) |
| ***B65D 53/00*** | (2006.01) |
| ***A45D 40/22*** | (2006.01) |

(52) U.S. Cl.

CPC ..... *A45D 33/003* (2013.01); *A45D 33/006* (2013.01); *A45D 40/222* (2013.01); *Y10S 206/823* (2013.01)

USPC ..... 132/293; 132/300; 206/581; 206/823; 220/263; 215/341

(58) Field of Classification Search

CPC ..... A45D 40/222; A45D 33/22; A45D 33/00; A45D 33/006; A45D 40/22; A45D 40/221; A45C 11/24; B65D 43/16; B65D 43/161

USPC ..... 132/293, 286, 294, 295, 300, 303, 305, 132/314, 315; 220/520, 521, 522, 523, 526, 220/531–534, 203.12, 203.25, 221, 222, 220/263, 300, 304, 840; 206/581, 823; 215/43, 44, 45, 211, 224, 240, 245, 215/341, 343, 344, 345, 346, 352

See application file for complete search history.

(56) References Cited

U.S. PATENT DOCUMENTS 4,570,811 A * 2/1986 Lecinski et al. ..... 215/343
4,586,519 A * 5/1986 Seidler et al. ..... 132/293

(Continued)

FOREIGN PATENT DOCUMENTS

JP 63-111811 U 7/1998
JP 10276834 A 10/1998

(Continued)

*Primary Examiner* — Vanitha Elgart
(74) *Attorney, Agent, or Firm* — Schmeiser, Olsen & Watts LLP

(57) ABSTRACT

The present invention provides a novel structure for sealing a cosmetic container using a double-injection molded rib on the container body sealing against a deformable hard-rubber ring on the container cover. The invention will maximize product reliability by improving the sealing structure of a make-up base or cosmetic container through providing a clear, air-tight effect since the sealing structure cannot be deformed, even in the case of long-term use. The invention provides uniform, airtight adhesion without unequal distribution of coupling intensity between internal sealing components when the container cover is closed. Further, the aesthetics of the container are increased because a closure clasp is not necessary, and it is possible to eliminate the problem of dried-out product created when the container is fitted with a closure clasp or similar device.

10 Claims, 10 Drawing Sheets

(56) References Cited

U.S. PATENT DOCUMENTS

| | | | | | |
|---|---|---|---|---|---|
| 4,674,644 | A * | 6/1987 | Jacobs | 215/320 |
| 4,696,317 | A * | 9/1987 | Shioi et al. | 132/314 |
| 4,951,692 | A * | 8/1990 | Yuhara et al. | 132/293 |
| 4,989,622 | A * | 2/1991 | Kozuka et al. | 132/301 |
| 5,269,431 | A * | 12/1993 | Sakata et al. | 220/203.17 |
| 5,295,496 | A * | 3/1994 | Machelett | 132/293 |
| 5,682,910 | A * | 11/1997 | Kizawa et al. | 132/293 |
| 5,704,378 | A * | 1/1998 | Machelett | 132/304 |
| 5,875,795 | A * | 3/1999 | Bouix | 132/293 |
| 5,884,636 | A * | 3/1999 | Sheffler et al. | 132/295 |
| 5,896,866 | A * | 4/1999 | Quennessen | 132/293 |
| 5,901,715 | A * | 5/1999 | Cambon et al. | 132/293 |
| 5,906,212 | A * | 5/1999 | Favre | 132/300 |
| 5,908,037 | A * | 6/1999 | Pierson | 132/293 |
| 5,950,638 | A * | 9/1999 | Crosta | 132/293 |
| 6,213,331 | B1 * | 4/2001 | Morgan et al. | 220/295 |
| 6,260,723 | B1 * | 7/2001 | Bergholtz | 215/344 |
| 6,336,460 | B2 * | 1/2002 | Yuhara | 132/295 |
| 6,345,627 | B1 * | 2/2002 | Petit | 132/293 |
| 6,354,308 | B1 * | 3/2002 | Kuk | 132/301 |
| 6,913,158 | B1 * | 7/2005 | Bosl et al. | 215/341 |
| 7,314,051 | B2 * | 1/2008 | Yuhara et al. | 132/294 |
| 7,410,073 | B2 * | 8/2008 | Yuhara | 220/212 |
| 7,451,877 | B2 * | 11/2008 | Koga et al. | 206/581 |
| 7,464,820 | B2 * | 12/2008 | Oh | 206/581 |
| 7,469,787 | B2 * | 12/2008 | Yuhara | 206/581 |
| 7,819,125 | B2 * | 10/2010 | Maelstaf | 132/293 |
| 7,832,564 | B2 * | 11/2010 | Kim | 206/581 |
| 7,878,212 | B2 * | 2/2011 | Ubertifoppa | 132/294 |
| 8,342,192 | B2 * | 1/2013 | Parker | 132/300 |
| 2002/0124863 | A1 * | 9/2002 | Gueret | 132/293 |
| 2002/0125205 | A1 * | 9/2002 | Hathaway et al. | 215/356 |
| 2006/0108315 | A1 * | 5/2006 | Britton | 215/321 |
| 2006/0118454 | A1 * | 6/2006 | Kang, III | 206/581 |
| 2009/0272399 | A1 * | 11/2009 | Kim | 132/293 |

FOREIGN PATENT DOCUMENTS

| | | | |
|---|---|---|---|
| KR | 200431983 | Y1 | 11/2006 |
| KR | 200440171 | Y1 | 5/2008 |

* cited by examiner

SEALING RING STRUCTURE OF A COSMETIC CONTAINER

TECHNICAL FIELD

The present invention relates to a cosmetic container for retaining moisture and scent of hue cosmetics in its continual use, and more particularly to a cosmetic container which ensures product reliability by preventing deformation and maximizing sealing ability in spite of long-term use of its sealing ring.

BACKGROUND ART

Recently, foundation or hue cosmetics were variously disclosed and such foundation or hue cosmetics have been used while they are filled up in portable cosmetic containers for the purpose of portability as well as keeping convenience.

For example, a compact is provided as a foundation contained and kept in a cosmetic container which is formed to a predetermined shape, and put on a face while used by intermediate means such as a puff.

However, such a foundation includes a volatile solvent which is harmless to humans, and such a volatile solvent is evaporated into air if it is not properly sealed, so that the foundation gets hardened rigidly till it cannot be used any more.

Moreover, the original scent carried by such foundation or hue cosmetics is evaporated, so that characteristics of the cosmetics cannot be ensured for a long time.

For such reasons, the cosmetic container of the foundation or hue cosmetics has a sealing structure where an inside is isolated from the outside while a cover is shut in order to prevent deterioration of the cosmetics filled therein.

The cosmetic container provided with such a sealing structure mainly comprises a lower container main body, an inner container received in the container main body and filled with cosmetics, a puff selectively received on the inner container, and an outer cover having a side part hinged to an upper part of the container main body and the opposite part locked or unlocked by locking means to be open or closed.

In this case, to retain moisture and scent of the cosmetics received in the inner container, an additionally provided gasket of an elastic rubber material is supportedly installed on a supporting frame which is provided at an outside of the inner container. Also, a protruding rib is included to press an upper surface of the gasket when the outer cover is closed so that sealing is maintained therebetween.

However, such a conventional sealing structure requires additionally forming and assembling a packing of an elastic rubber material for maintaining the sealing of the inner container from the outside, so that productivity and assembling workability are lowered and the manufacturing cost rises.

To solve such problems, a cosmetic container having a sealing structure as shown in FIG. 1 has been disclosed.

That is, as shown in FIG. 1, an insert groove 3*a* is formed along an upper side of a supporting body 3 which is provided at an outside of an inner container 5 of a container main body 2. Rubber in a liquid state is filled and hardened in the insert groove 3*a* to form and fix a sealing hardened rubber 4. Therefore, when an outer cover 6 is closed and held by a push button 7 of a locking part to maintain a closed state, a rib 6*a* integrally formed on a bottom surface of the outer cover 6 is tight on the hardened rubber 4 to maintain sealing.

Such technology enables doubling the sealing ability with a simple structure by using the liquid rubber. Also, as the liquid rubber is filled and hardened to install the hardened rubber, there are advantages in reducing the manufacturing cost as well as improving the productivity and the assembling workability.

According to such a prior art, as shown in an expanded view of FIG. 1*b*, the hardened rubber 4 is hardened in a state of shrinking concavely at a center part thereof due to surface tension during the hardening of the liquid rubber which has been firstly inserted. As the rib 6*a* contacting a surface of the hardened rubber 4 is provided as a plastic protrusion harder than the hardened rubber 4, the sealing is accomplished by maintaining the hardened rubber 4 strongly pressed when the outer cover is in its closed state.

However, the hardened rubber 4 in a pressed state due to the rib 6*a* does not restore properly from the pressed state when the pressed state is released by opening the outer cover. That is, as shown in FIG. 1*c*, a groove 4*a* is formed in the hardened rubber due to a plastic deformation relating to fatigue strength and its deformation is enlarged due to a repetitive pressing contact of the rib 6*a* with a long-term use.

Moreover, as the rib 6*a* integrally formed in protrusion on the bottom surface of the outer cover 6 undergoes a twist deformation due to a temperature change after it has been formed, the rib 6*a* comes not to have a uniform contacting end surface.

In other words, though sealing force between the outer cover and the inner container is maintained in the early stage of use, a twist deformation of the outer cover, a shrinking deformation of the sealing ring and etc. in the long-term use generate coming-off at a part of the tight interface therebetween, so that the sealing of a receiving space of the inner container cannot be maintained.

DISCLOSURE

Technical Problem

A sealing structure of a conventional sealing cosmetic container gradually loses its sealing ability because it is readily deformed due to a long-term use.

The present invention enables maintaining a certain sealing and securing lifetime sealing characteristics, thus securing product reliability by improving a sealing structure of a container of foundation or hue cosmetics and maximizing prevention of deformation of the sealing structure.

Therefore, the sealing structure of the foundation or hue cosmetic container of an open and close type with a push button according to a first embodiment of the present invention is in that a rib previously provided to an outer cover is coupled to a container main body, a hardened rubber inserted and hardened in an insert groove of a supporting body which receives an inner container is formed by double injection molding of elastomer, so that deformation of the hardened rubber can be prevented and the sealing characteristics can be maximized.

Also, the sealing structure of the foundation or hue cosmetic container of the open and close type without a push button according to a second embodiment of the present invention is in that the outer cover is of a pulling type (lifting) or a pushing type (pressing) so that contact of a sealing ring provided inside operates evenly without bias when the outer cover is closed at the same time, and coming-off phenomenon of the sealing ring can be prevented and the sealing characteristics can be maximized.

According to the above second embodiment of the present invention, opening and closing means of the outer cover is not exposed, so that the outer cover cannot be opened by inadvertent pushing of the push button during keeping. Therefore, stability can be ensured and the external aesthetic appearance can be enhanced.

Technical Solution

In order to accomplish the above object, a sealing ring structure of a cosmetic container according to a first embodiment of the present invention comprises a container main body; a supporting body receiving an inner container which is coupled to the container main body and filled with cosmetics, and having on its upper surface an insert groove in which liquid rubber is filled and hardened to form a hardened rubber; and an outer cover being at a side thereof hinged to the container main body, having at the opposite side thereof a lock part capable of maintaining and releasing a lock state for opening and closing the inner container, and having at a bottom surface thereof a rib which seals a receiving room of the inner container by tightly contacting the hardened rubber and which is made of elastomer other than the hardened rubber.

According to an aspect of the present invention, the elastomeric rib is provided and attached to the outer cover by double injection molding.

According to an aspect of the present invention, the elastomeric rib has a cross sectional structure of 'L' shape to have a large area of a portion adhered to the outer cover.

Also, a sealing ring structure of a cosmetic container according to a second embodiment of the present invention comprises a container main body formed with a hanging step and an assembling recess at an inner round surface and an outer round surface of an upper end opening thereof; an inner container having a horizontal flange protruding around an outer round surface thereof to be coupled to the hanging step of the container main body, and having at an upper surface thereof a sealing protrusion with a holding step at its outer round surface; a shoulder having at an lower end thereof an inwardly curved ring protruding inwardly to be assembled to the assembling recess in order to finish an upper part of the horizontal flange of the inner container for preventing the inner container form separating; an outer cover formed at an inner round surface thereof with a holding recess and having at a side thereof a protruding hinge arm to be hinge-coupled to the shoulder; and an inner cover having at an outer round surface thereof a holding protrusion to be coupled to the holding recess of the outer cover, having at an inside of the holding protrusion inner and outer protrusion rings with a predetermined interval therebetween to form a sealing receiving groove, and having at the outer protrusion ring a plurality of elastic holding arms with a predetermined width respectively and with a predetermined interval therebetween to extend downwardly and to have at each lower end a holding protrusion step, wherein the holding protrusion step of the elastic holding arm of the inner container is elastically held by the holding step of the sealing protrusion of the inner cover when the outer cover is closed by its hinge-rotation, and an upper end of the sealing protrusion tightly contacts the sealing receiving groove when it is inserted in the sealing receiving groove at the same time so that a receiving room of the inner container is sealed.

According to an aspect of the present invention, the sealing protrusion is made of elastomer which is formed with a step coupling on an outer round surface of an opening end of the receiving room of the inner container by double injection molding.

According to an aspect of the present invention, the sealing protrusion is formed as a round protrusion with an egg-shaped end surface which becomes narrow upwardly to have elastic restoring force, and the elastic holding arm is formed as a round surface whose inner surface receives an outer round surface of the sealing protrusion in a state that the inner surface becomes more narrow till its lower end.

According to an aspect of the present invention, the elastic holding arm forms a split recess together with the outer protrusion ring to have a high elastic restoring force, and the split recess extends from a bottom surface of the elastic holding arm.

According to an aspect of the present invention, three of the elastic holding arms are provided which are formed at the opposite side of the hinge arm of the outer cover and at both sides perpendicular to the opposite side.

According to an aspect of the present invention, silicon rubber is filled and formed in the sealing receiving groove to tightly contact an upper surface of the sealing protrusion.

According to an aspect of the present invention, an elastomeric protrusion ring formed as a round protrusion with an egg-shaped end surface is formed at an inside of the elastic holding arm of the inner cover, an upper end of the inner container is formed with a holding step to hold the holding protrusion step which protrudes inwardly from the elastic holding arm of the inner cover, and the upper end of the inner container is formed as a sealing base which the round protrusion with an egg-shaped end surface of the elastomeric protrusion ring contacts tightly.

According to an aspect of the present invention, the sealing base is formed at its upper part with an insert groove where silicon rubber is filled and hardened.

Advantageous Effects

According to the first embodiment of the present invention, a rib which tightly contacts a hardened rubber filled and hardened for sealing is formed of an elastic material of a different kind, so that deformation can be offset in spite of a pressing contact, sealing characteristics can be maximized by preventing deformation due to fatigue, and therefore product reliability can be improved.

According to the second embodiment of the present invention, opening and closing means of the outer cover is of a pulling or pushing type without a button, and contact of a sealing ring provided inside is distributed evenly when the outer cover is closed at the same time, so that coming-off phenomenon of the sealing ring can be prevented, and therefore the sealing characteristics can be enhanced.

Also, the opening and closing means of the outer cover is not exposed, so that the outer cover is not opened during keeping and therefore stability during keeping can be ensured.

Also, there is no need of the opening and closing means of the outer cover, so that parts number can be minimized and prevented from being exposed to an outside, and therefore external aesthetic appearance can be enhanced and the product reliability can be ensured.

DESCRIPTION OF DRAWINGS

FIGS. 1*a* to 1*c* are sectional views of a previously used cosmetic container with a sealing structure, wherein FIG. 1*a* is an entire sectional view with a close state of an outer cover, FIG. 1*b* is an expanded view of a partial extract of FIG. 1*a*, and FIG. 1*c* is an expanded view of the partial extract in a state of an opening operation of the outer cover.

DESCRIPTIONS OF NUMERALS FOR PRINCIPAL PARTS IN THE DRAWINGS

Figure 1A:
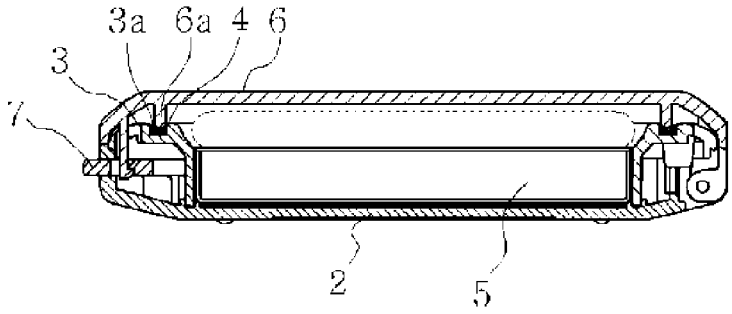
FIG. 1a (Prior Art)
Figure 1B:
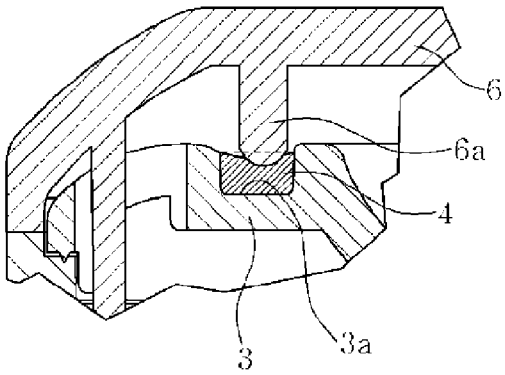
FIG. 1b (Prior Art)
Figure 1C:
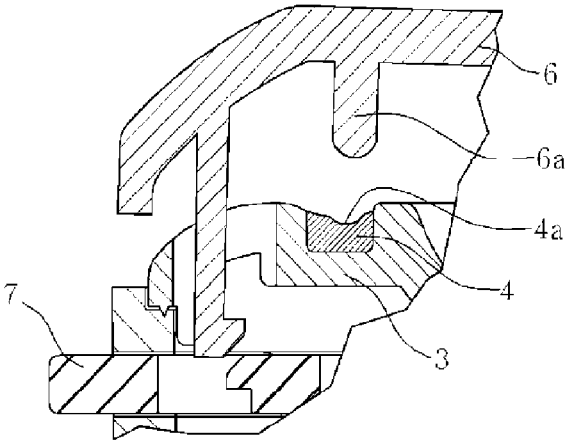
FIG. 1c (Prior Art)

10,100: container main body, 15: supporting body
18,18*a*: hardened rubber, 20,200: inner container
40,400: outer cover, 48,48*a*: elastomer rib
110: receiving chamber, 120: hanging step
130: assembling recess, 210: receiving room
220: horizontal flange, 230: sealing protrusion
231: holding step, 232: round protrusion with an egg-shaped end surface, 300: shoulder, 310: inwardly curved ring, 420: reducing round surface, 430: holding recess
500: inner cover, 510: holding protrusion
520: inner protrusion ring, 530: outer protrusion ring, 531: split recess 540: sealing receiving groove,
550: elastic holding arm, 551: holding protrusion step, 552: round surface, 560: silicon rubber

BEST MODE

The present invention is characterized in that a rib of an outer cover which tightly contacts a hardened rubber is formed by dual injection molding with elastomers of different kinds having elastic restoring force in order to fully prevent deformation of the hardened rubber which is formed in a supporting body of an inner container, so that, when the outer cover is closed, contacting force between inner sealing members can be uniformly distributed to get a strong sealing force.

Hereinafter, constitution and operation of the present invention to achieve the above object are described in detail with reference to the drawings attached.

In the description of the present invention, structures and sizes of the presented drawings may be simplified or abbreviated unless they cause inconveniences to the description of the invention.

Figure 2:
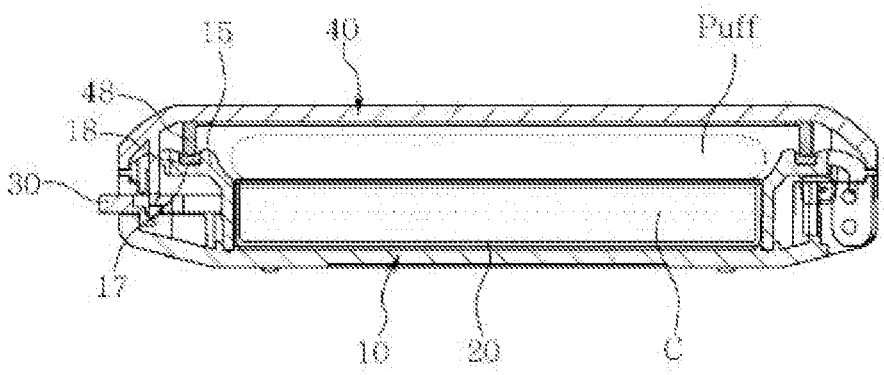
FIG. 2 is a sectional view of an assembled state of a first embodiment of the present invention.
Figure 3:
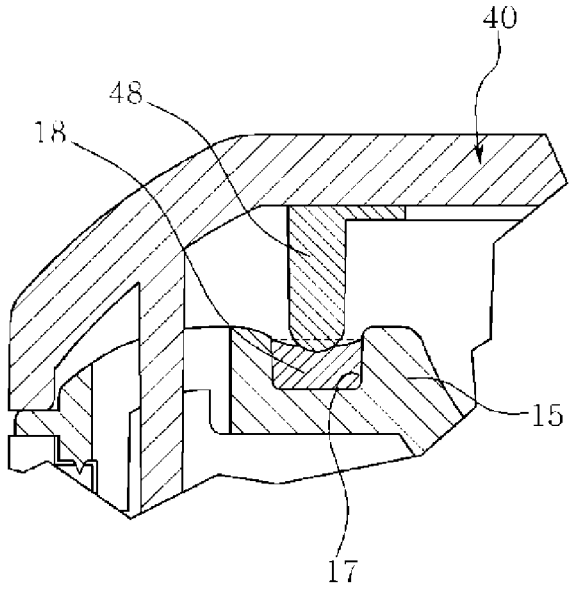
FIG. 3 is an expanded view of a partial extract of FIG. 2.

As shown in FIGS. 2 and 3, a first embodiment of the present invention comprises a container main body 10, a supporting body 15 received in an inner space of the container main body, an inner container 20 coupled in an inner space of the supporting body 15 with cosmetics C filled therein, an outer cover 40 having a side part hinged to the container main body 10 and the other side part operated to be open or close by maintaining or releasing its locking state through push operation of a push button 30.

The supporting body 15 has an insert groove 17 formed along an upper surface so that liquid rubber is filled and hardened in the insert groove 17 to form a hardened rubber 18.

A rib 48 which contacts the hardened rubber 18 in a tightly pressed state is formed on a bottom surface of the outer cover 40 through a double injection molding of an elastomer.

Although the elastomeric rib 48 may also be separately formed and attached onto the bottom surface of the outer cover 40 using an adhesive, it has problems of an incorrect adhering position and deformation due to the adhering process. Therefore, the double injection molding is preferable.

Such an elastomeric rib 48 shows no twisting deformation, after it has been formed, due to its material characteristics in the restoring force and the elastic force. Also, when contacting the hardened rubber 18, an elastic deformation offset therebetween enables maintaining a long-term of sealing characteristics without plastic deformation due to fatigue and ensures reliability.

In other words, when the outer cover 40 is operated to be closed so that lower end surface of the elastomeric rib 48 contacts the hardened rubber 18 in a pressed state, the elastic restoring forces act at both of them. Therefore, the hardened rubber 18 can tightly contact without plastic deformation due to fatigue.

Figure 4:
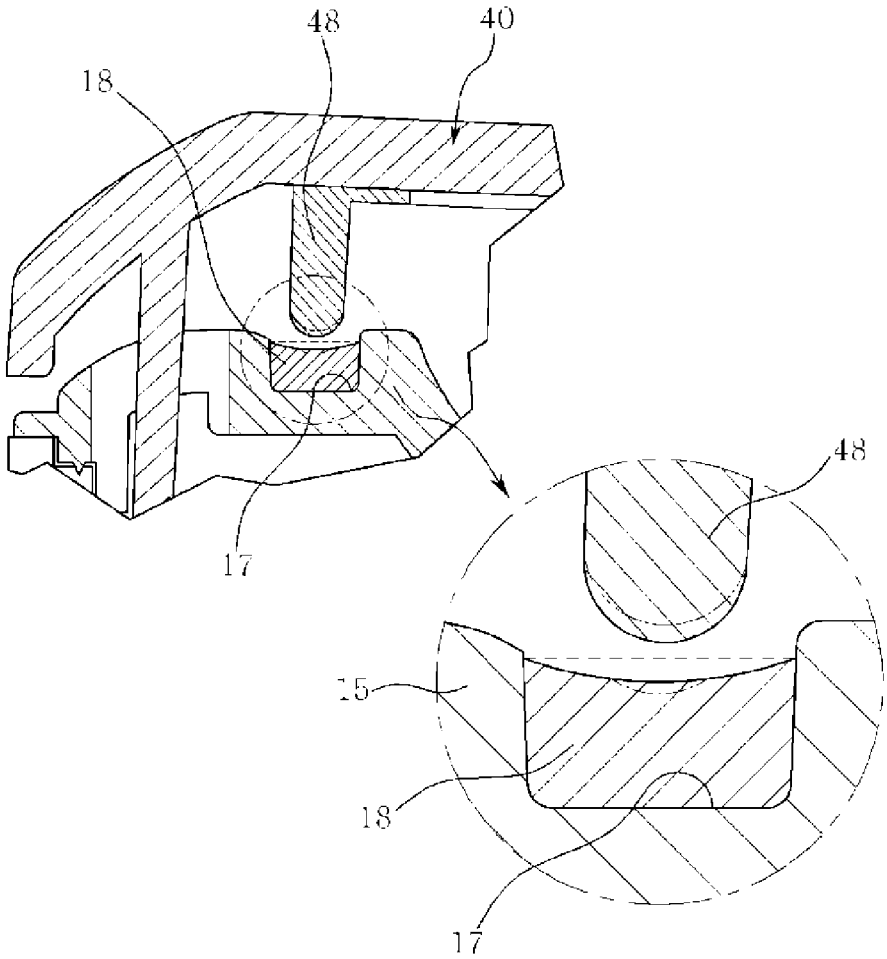
FIG. 4 is an expanded view of a partial extract of FIG. 2 according to an opening operation of an outer cover in the first embodiment of the present invention.

From this state, as shown in FIG. 4, when the outer cover 40 is operated to be open, the elastomeric rib 48 and the hardened rubber 18 restore to their original state.

The elastomeric rib 48 is formed to have a cross sectional structure of 'L' shape to have a large area of an adhering portion.

Of course, it may also have a cross sectional structure of 'T' shape.

Such a cross sectional structure of the elastomeric rib 48 allows an adhering strength with respect to an elastic compression according to the pressing contact of the hardened rubber 18 and prevents deformation when it contacts the outer cover 40.

Figure 5:
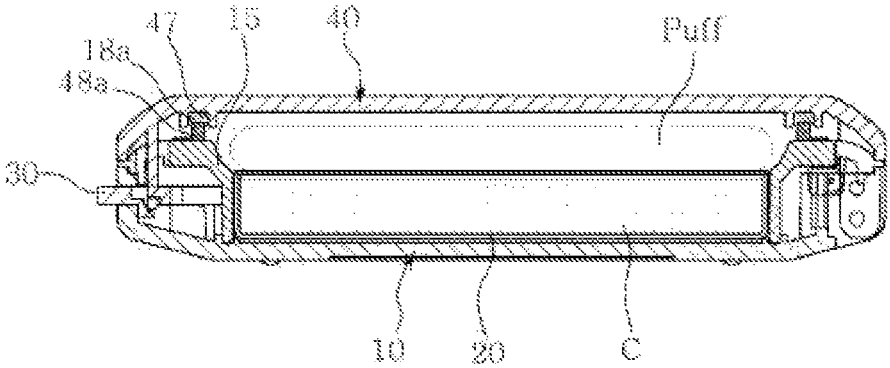
FIG. 5 shows a modification of the first embodiment of the present invention.
Figure 6:
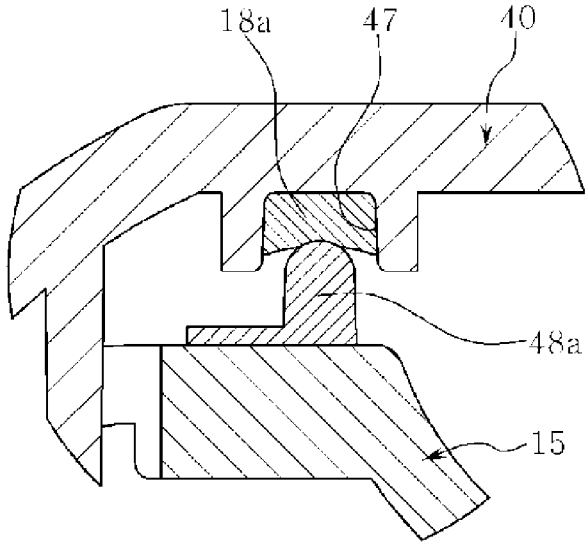
FIG. 6 is an expanded view of a partial extract of FIG. 5.
Figure 7:
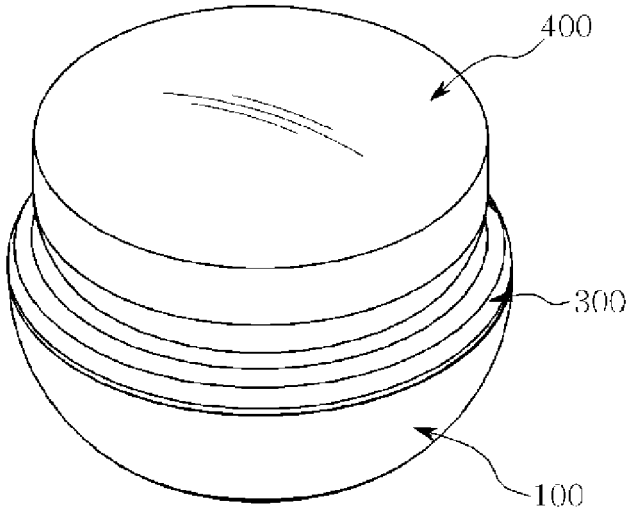
FIG. 7 is a perspective view of an external appearance of a second embodiment of the present invention.

The present invention described above, as shown in FIG. 5 and FIG. 6, may have the insert groove 47 integrally formed with the outer cover 40 and the liquid rubber filled and hardened therein to form the hardened rubber 18*a*, and the elastomeric rib 48*a* formed on the upper surface of the supporting body 15 by the double injection molding to tightly contact the hardened rubber 18.

Hereinafter, a second embodiment of the present invention is described with reference to FIGS. 7 to 11.

Figure 8:
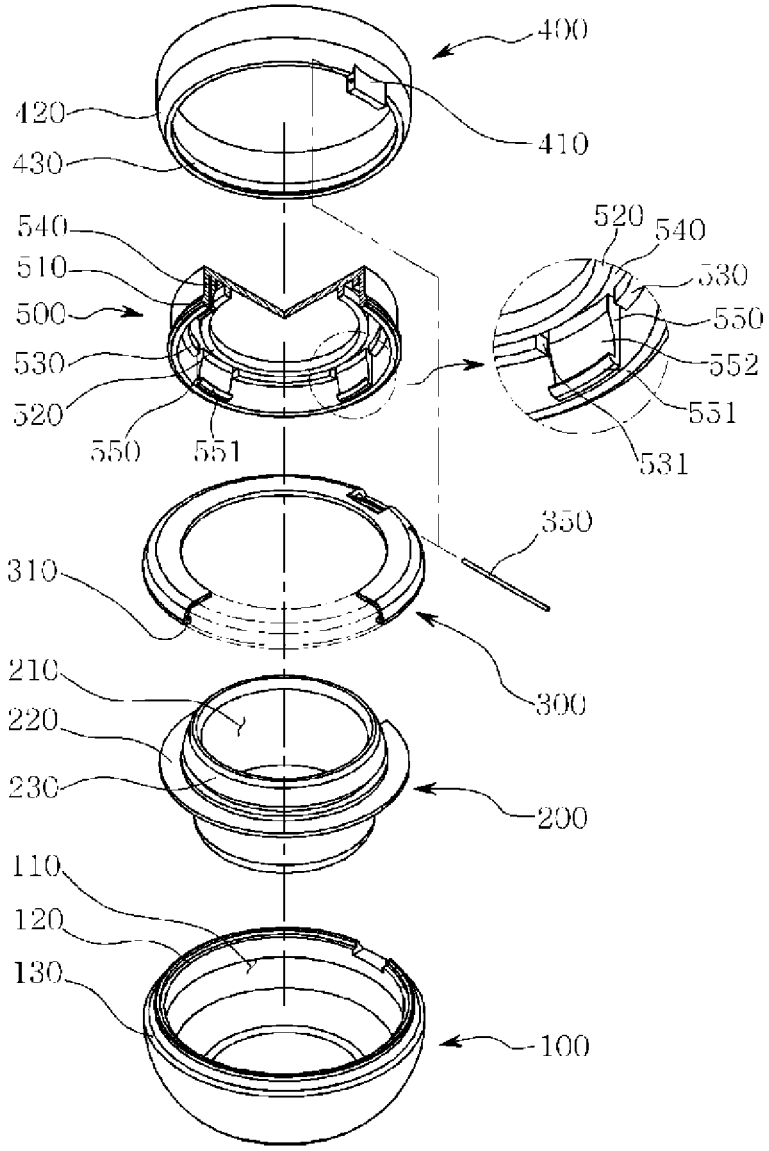
FIG. 8 is an exploded perspective view of elements constituting the second embodiment of the present invention.

As shown in FIG. 8, the cosmetic container according to this embodiment comprises a lower container main body 100, an inner container 200 assembled to the container main body 100, a shoulder 300 assembled to an upper round surface of the container main body 100 to prevent the inner container 200 from separating upwardly, an upper outer cover 400 hinged to the shoulder 300 to rotate, and an inner cover 500 assembled within the outer cover 400 and thus having its external shape shown in FIG. 2.

Figure 9:
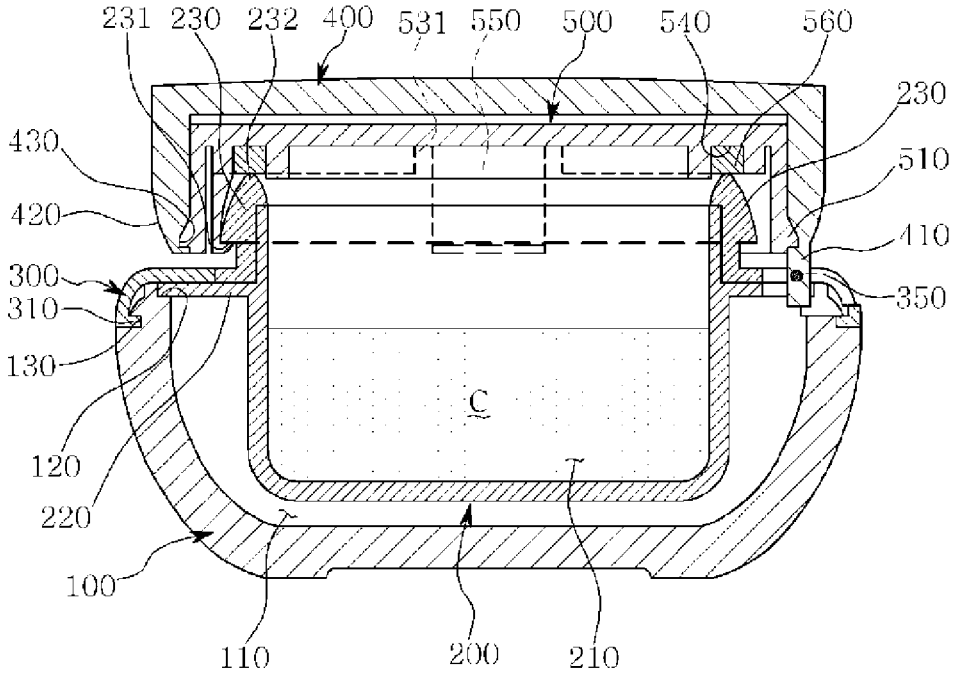
FIG. 9 is a sectional view of an assembled state of the second embodiment of the present invention.
Figure 10:
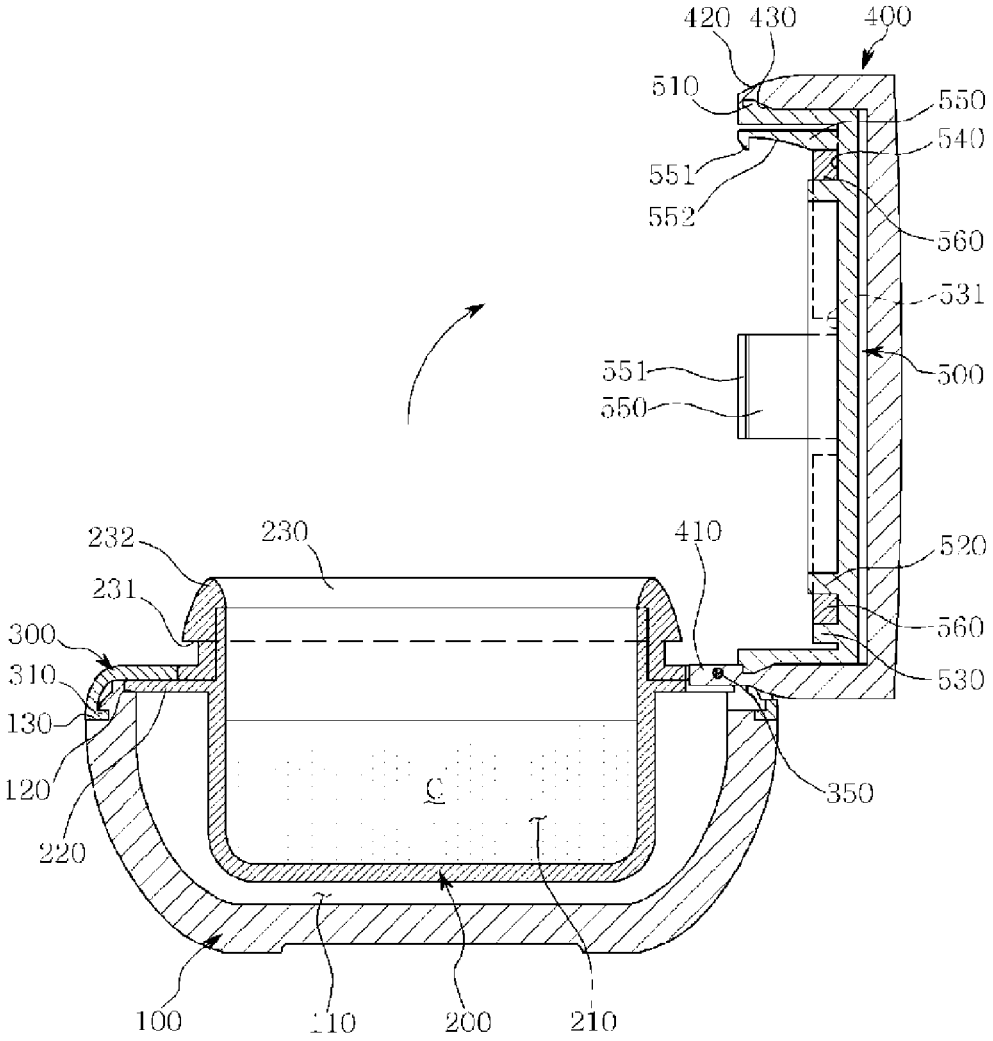
FIG. 10 is a sectional view of the second embodiment of the present invention in a state of an open outer cover.

Further referring to FIG. 9 and FIG. 10, the container main body 100 has a hanging step 120 and an assembling recess formed at an inner round surface and an outer round surface of an upper end opening of an inner receiving chamber 110.

The inner container 200 has an inner receiving room 210 to receive the cosmetics C and a horizontal flange 220 at an outer round surface. Also, a sealing protrusion 230 having a holding step 231 is formed on an upper end round surface of the receiving room 210.

Figure 11:
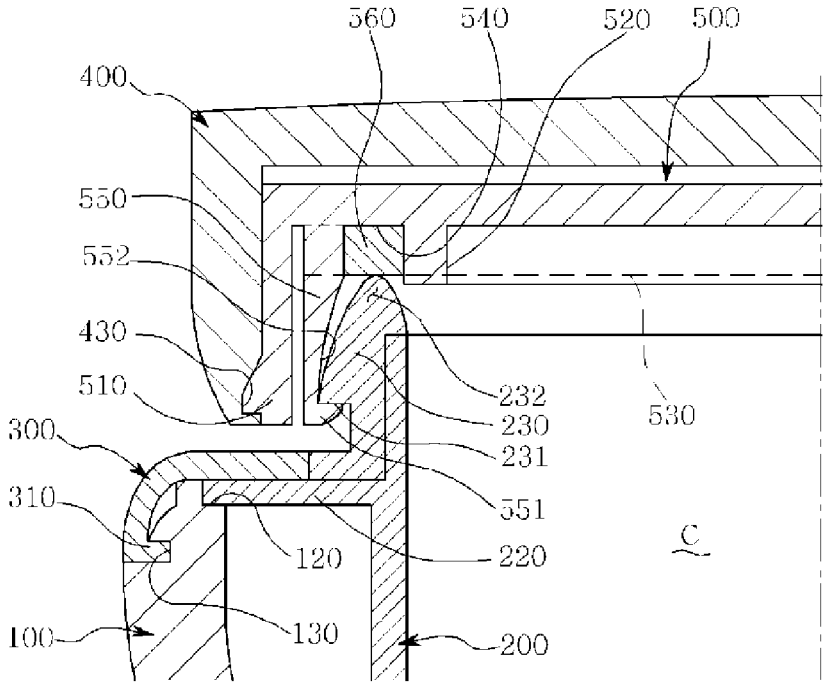
FIG. 11 is an expanded view of a partial extract of FIG. 4.

As shown in an expanded view of a partial extract of FIG. 11, it is preferable that the sealing protrusion 230 is made of elastomer which is formed on an outer round surface of an inlet opening of the receiving room 210 of the inner container 200 with a step-coupling by the double injection molding.

Such a sealing protrusion 230 is formed as a round protrusion 232 with an egg-shaped end surface where the holding step 231 and its opposite side become narrow therebetween to have an elastic restoring force.

Such an inner container 200 is received in the receiving chamber 110 of the container main body 100, and is received and assembled in a state of the horizontal flange 220 mounted on the hanging step 120.

An interface between the horizontal flange 220 of the inner container 200 and the hanging step 120 of the container main body 100 is finished by the assembling of the shoulder 300.

Such a shoulder 300 is assembled with an inwardly curved ring 310 which protrudes under and in the assembling recess 130 of the container main body 100 to prevent separation of the inner container 200.

To the shoulder 300 is connected a hinge arm 410, which protrudes at a side of the outer cover 400, by a hinge pin 350. As shown in FIG. 10, the outer cover 400 is provided to open and close the receiving room 210 of the inner container 200 by its hinge rotation around the hinge pin 350.

Such an outer cover 400 is formed at its lower end part with a reducing round surface 420, whose diameter is reduced inwardly for a user to have a grasp force, to ensure easiness in opening and closing. A holding recess 430 is formed at an inner round surface of the outer cover 400.

The inner cover 500 is assembled by interference fit within the outer cover 400.

The inner cover has a holding protrusion 510 protruding at an outer round surface to be assembled to the holding recess 430 of the outer cover 400 to prevent separation therebetween.

The inner cover 500 is formed with a sealing receiving groove 540 between inner and outer protrusion rings 520, 530 which protrude within the holding protrusion 510 with a predetermined interval therebetween, and formed with elastic holding arms 550 with a predetermined width respectively and with a predetermined interval therebetween to extend downwardly from the outer protrusion ring 520 and to have a holding protrusion step 551 at each lower end.

It is preferable that such a elastic holding arm 550 is formed with the outer protrusion ring 530 and a split recess 531 to have a much elastic restoring force, extends from a bottom surface, and formed with a round surface 552 to receive an outer round surface of the sealing protrusion 230 of the inner container 200 in a state of its inner surface getting narrower downwardly.

Also, it is preferable that three elastic holding arms 550 are provided, that is, at the opposite side of the hinge arm 410 of the outer cover 400 and at both sides perpendicular to the opposite side.

Accordingly, a receiving sealing contact between the sealing protrusion 230 of the inner container 200 and the sealing receiving groove 540 of the inner cover 500 is accomplished by the sealing force which is operated by the left-side elastic holding arm 550 and sealing protrusion 230 and the right-side hinge part and by the sealing force which is operated by the front and rear elastic holding arms 550 perpendicular to the left-side holding arm 550 and the sealing protrusion 230 at the same time, so that the sealing ability can be enhanced by such strong sealing force.

Also, a silicon rubber 560 is filled and hardened in the sealing receiving groove 540 to be tightly contacted by the sealing protrusion 230 in order to further enhance the sealing characteristics.

Also, although it is not shown in the figures, a mirror may be attached for use in a recess part formed by the inner protrusion ring 520 of the inner cover 500.

According to the present invention described above, when the outer cover 400 is closed by its hinge rotation, the holding protrusion step 551 of the elastic holding arm 550 of the inner cover 200 is elastically held by the holding step 231 of the sealing protrusion 230 formed to the inner cover 500, and at the same time, the upper end of the round protrusion 232 with the egg-shaped end surface of the sealing protrusion 230 presses the silicon rubber 560 filled and hardened in the sealing receiving groove 540 to accomplish the sealing. Therefore, the receiving room 210 of the inner container 200 is tightly sealed, so that the volatile solvent and the original scent contained in the cosmetics C is prevented from evaporating.

In this case, the elastic holding arms 550 of the inner cover 500 are formed in three directions, that is, at the opposite side of the hinge arm 410 of the outer cover 400 and at the front and the rear sides perpendicular to the opposite side, the round protrusion 232 with the egg-shaped end surface of the sealing protrusion 230 of the inner container 200 is received in the sealing receiving groove 540 of the inner cover 500 by the closing of the outer cover 400, and at the same time, an even tight sealing is provided. Therefore, the coming-off phenomenon is prevented and the sealing characteristics can be enhanced.

Figure 12:
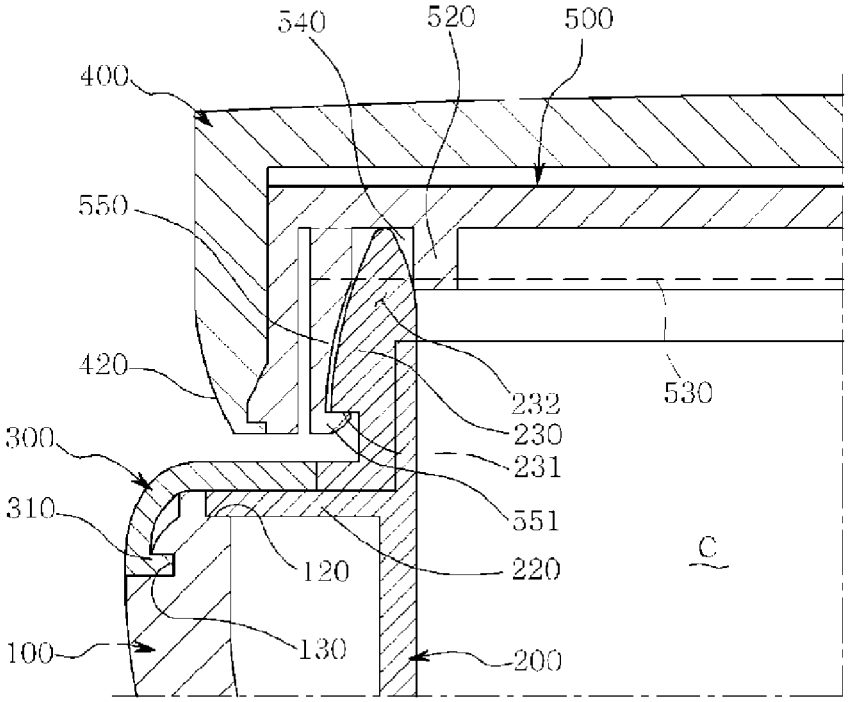
FIGS. 12 to 15 are sectional views of extracts of modifications of the second embodiment of the present invention.

Of course, as shown in FIG. 12, even if there is no silicon rubber 560, the round protrusion 232 with the egg-shaped end surface of the sealing protrusion 230 may be received in the sealing receiving groove 540 and pressed at the same time to accomplish the tight contact and sealing by forming the sealing protrusion 230 of the inner container 200 to have its protruding length so that it can be pressed as well as received in the sealing receiving groove 540 of the inner cover 500.

Figure 13:
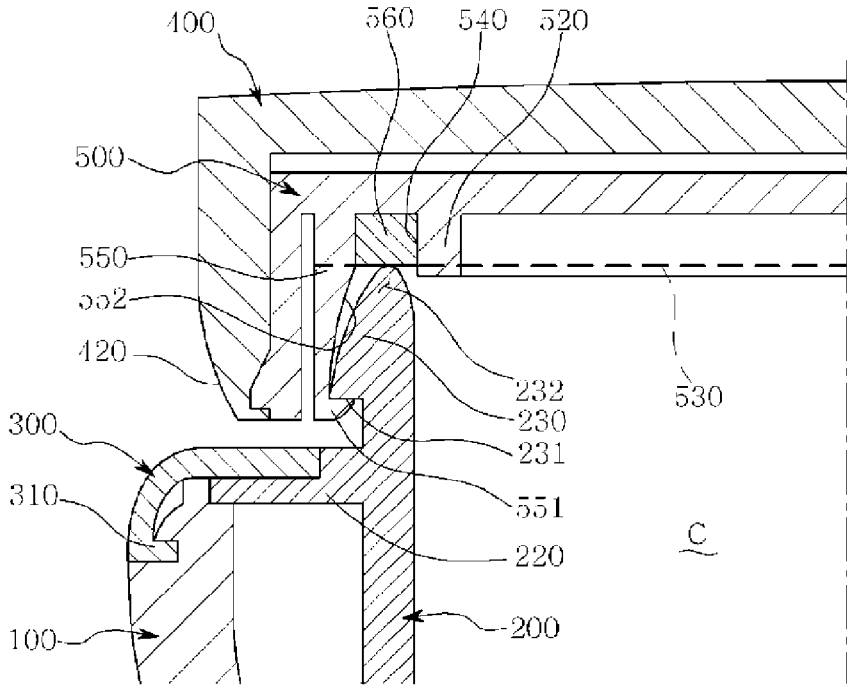

Also, as shown in FIG. 13, even if the sealing protrusion 230 of the inner container 200 is formed to have the same material as the inner container 200 and the silicon rubber 560 is formed in the sealing receiving groove 540 of the inner cover 500, the soft silicon rubber 560 can be pressed and tightly contacted by the sealing protrusion 230 of the inner container 200 of a hard plastic material to accomplish the sealing.

Figure 14:
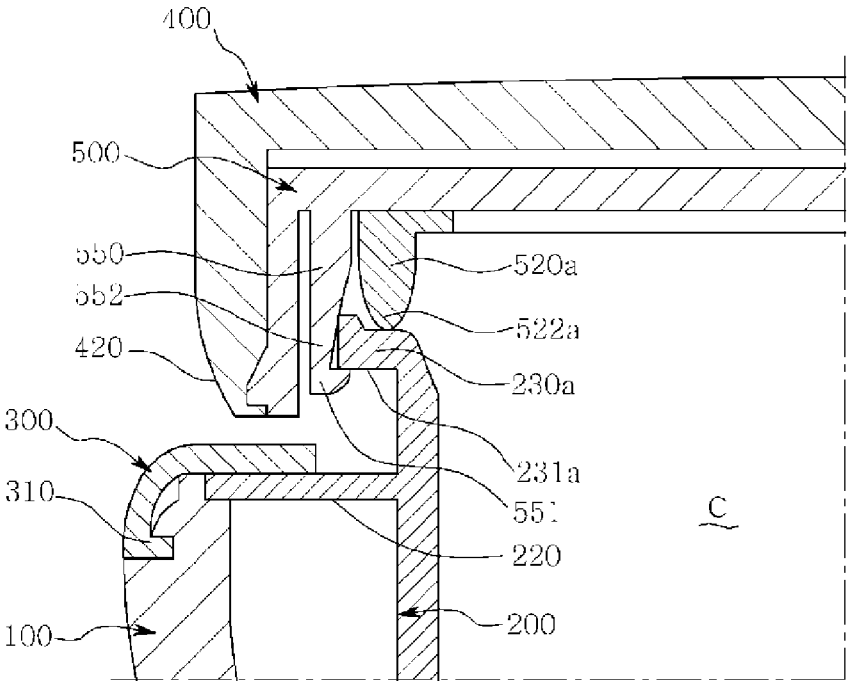

Also, as shown in FIG. 14, the elastic holding arm 550 of the inner cover 500 may be formed therein with an elastomeric protrusion ring 520*a* having a round protrusion 522*a* with an egg-shaped end surface, a holding step 231*a* may be formed at a top end of the inner container 200 to hold the holding protrusion step 551 which protrudes inwardly at the elastic holding arm 550 of the inner cover 500, and a sealing base 230*a* may be formed to be tightly contacted by the elastomeric round protrusion 522*a* with the egg-shaped end surface.

Figure 15:
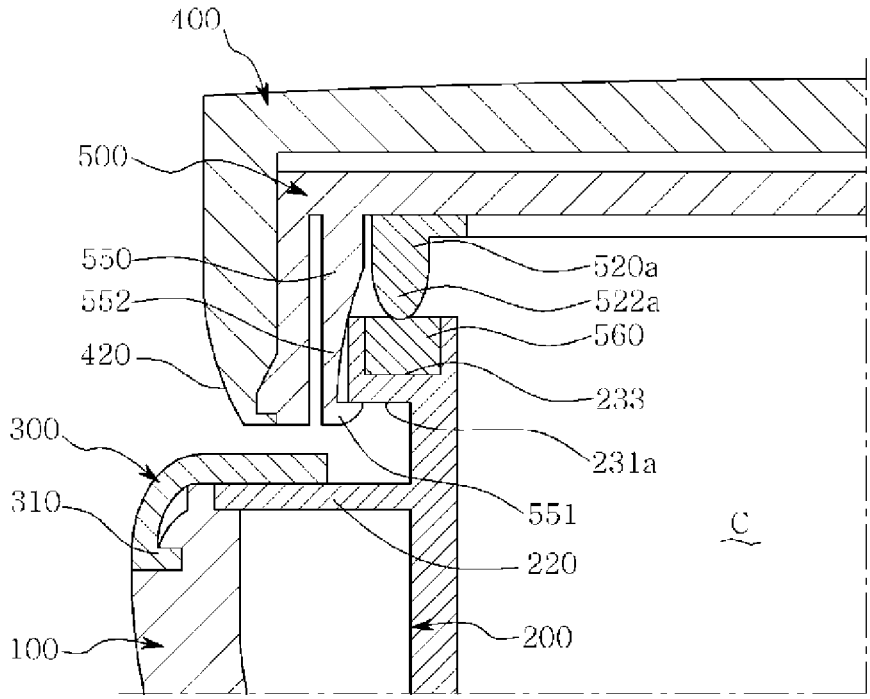

In this case, as shown in FIG. 15, the sealing base 230*a* is formed with an insert groove 233 on its upper surface to fill and harden the silicon rubber 560.

Although the above embodiments have similar operations and functions as the preferable embodiment of the present invention, there is a small difference in that the elastomeric protrusion ring 520*a* is pressed by the upper surface of the sealing base 230*a* or the silicon rubber 560 to accomplish the sealing when the outer cover 400 is closed so that the receiving room 210 of the inner container 200 can be sealed.

[Industrial Applicability]

The present invention can enhance sealing characteristics of an inner container in use and keeping and ensure product reliability to customers by minimizing deterioration of foundation or hue cosmetics in spite of long-term use.

The invention claimed is:

1. A sealing ring structure of a cosmetic container comprising:

a container main body formed with a hanging step and an assembling recess at an inner round surface and an outer round surface of an upper end opening thereof;

an inner container having a horizontal flange protruding around an outer round surface thereof to be coupled to the hanging step of the container main body, and having at an upper surface thereof a sealing protrusion with a holding step at its outer round surface;

a shoulder having at a lower end thereof an inwardly curved ring protruding inwardly to be assembled to the assembling recess in order to finish an upper part of the horizontal flange of the inner container for preventing the inner container from separating;

an outer cover formed at an inner round surface thereof with a holding recess and having at a side thereof a protruding hinge arm to be hinge-coupled to the shoulder; and an inner cover having at an outer round surface thereof a holding protrusion to be coupled to the holding recess of the outer cover, having at an inside of the holding protrusion inner and outer protrusion rings with a predetermined interval therebetween to form a sealing receiving groove, and having at the outer protrusion ring a plurality of elastic holding arms with a predetermined width respectively and with a predetermined interval therebetween to extend downwardly and to have at each lower end a holding protrusion step, wherein the holding protrusion step of the elastic holding arm of the inner cover is elastically held by the holding step of the sealing protrusion of the inner container when the outer cover is closed by its hinge-rotation, and an upper end of the sealing protrusion tightly contacts the sealing receiving groove when it is inserted in the sealing receiving groove at the same time so that a receiving room of the inner container is sealed.

2. The sealing ring structure of a cosmetic container according to claim 1, wherein the sealing protrusion is made of elastomer which is formed with a step coupling on an outer round surface of an opening end of the receiving room of the inner container by double injection molding.

3. The sealing ring structure of a cosmetic container according to claim 1, wherein the sealing protrusion is formed as a round protrusion with an egg-shaped end surface which becomes narrow upwardly to have elastic restoring force, and the elastic holding arm is formed as a round surface whose inner surface receives an outer round surface of the sealing protrusion in a state that the elastic holding arm inner surface becomes more narrow downwardly to its lower end.

4. The sealing ring structure of a cosmetic container according to claim 3, wherein the elastic holding arm forms a split recess together with the outer protrusion ring to have a high elastic restoring force, and the split recess extends from a bottom surface of the elastic holding arm.

5. The sealing ring structure of a cosmetic container according to claim 3, wherein three of the elastic holding arms are provided which are formed at the opposite side of the hinge arm of the outer cover and at both sides perpendicular to the opposite side.

6. The sealing ring structure of a cosmetic container according to claim 1, wherein silicon rubber is filled and formed in the sealing receiving groove to tightly contact an upper surface of the sealing protrusion.

7. The sealing ring structure of a cosmetic container according to claim 1, wherein an elastomeric protrusion ring formed as a round protrusion with an egg-shaped end surface is formed at an inside of the elastic holding arm of the inner cover, an upper end of the inner container is formed with the holding step to hold the holding protrusion step which protrudes inwardly from the elastic holding arm of the inner cover, and the upper end of the inner container is formed as a sealing base which the round protrusion with an egg-shaped end surface of the elastomeric protrusion ring contacts tightly.

8. The sealing ring structure of a cosmetic container according to claim 7, wherein the sealing base is formed at its upper part with an insert groove where silicon rubber is filled and hardened.

9. The sealing ring structure of a cosmetic container according to claim 2, wherein the sealing protrusion is formed as a round protrusion with an egg-shaped end surface which becomes narrow upwardly to have elastic restoring force, and the elastic holding arm is formed as a round surface whose inner surface receives an outer round surface of the sealing protrusion in a state that the elastic holding arm inner surface becomes more narrow downwardly to its lower end.

10. The sealing ring structure of a cosmetic container according to claim 2, wherein silicon rubber is filled and formed in the sealing receiving groove to tightly contact an upper surface of the sealing protrusion.

* * * * *